US012467263B2

(12) United States Patent
Kuster et al.

(10) Patent No.: US 12,467,263 B2
(45) Date of Patent: Nov. 11, 2025

(54) FACADE FASTENING SYSTEM HAVING PROFILE ELEMENTS

(71) Applicant: SFS Group International AG, Heerbrugg (CH)

(72) Inventors: Hanspeter Kuster, Balgach (CH); Roland Mair, Götzis (AT); Ben Kemp, Hartfield Broad Oak (GB)

(73) Assignee: SFS Group International AG, Heerbrugg (CH)

( * ) Notice: Subject to any disclaimer, the term of this patent is extended or adjusted under 35 U.S.C. 154(b) by 342 days.

(21) Appl. No.: 17/886,566

(22) Filed: Aug. 12, 2022

(65) Prior Publication Data

US 2023/0078761 A1 Mar. 16, 2023

(30) Foreign Application Priority Data

Aug. 12, 2021 (EP) ..... 21191138

(51) Int. Cl.
*E04F 13/08* (2006.01)

(52) U.S. Cl.
CPC ..... *E04F 13/0857* (2013.01); *E04F 13/0816* (2013.01)

(58) Field of Classification Search
CPC ..... E04F 13/0857; E04F 13/0816; E04F 13/0835; E04F 13/0841; E04F 13/0801; E04F 13/08; E04F 13/0805; E04F 13/081; E04F 13/0814; E04F 13/083; E04F 13/0851; E04F 13/086; E04F 13/22; E04F 13/24; E04F 13/0889; E04F 13/0826; E04F 13/5427
See application file for complete search history.

(56) References Cited

U.S. PATENT DOCUMENTS

| | | | | |
|---|---|---|---|---|
| 7,922,945 | B2 * | 4/2011 | Bentmar | B32B 37/0038 156/244.11 |
| 9,091,080 | B2 * | 7/2015 | Wilkie | E04B 1/7038 |
| 9,109,368 | B2 * | 8/2015 | MacKenzie | E04F 19/065 |
| 10,907,361 | B2 * | 2/2021 | Sawada | E04F 13/0826 |

(Continued)

FOREIGN PATENT DOCUMENTS

| | | |
|---|---|---|
| AT | 11317 | 8/2010 |
| EP | 356873 | 3/1990 |

(Continued)

*Primary Examiner* — Rodney Mintz
(74) *Attorney, Agent, or Firm* — Volpe Koenig

(57) ABSTRACT

A profile element for attachment to the rear side of a façade panel, which in turn is fastened to a base such as a building surface or substructure. The profile element is formed in one piece and includes three functional sections arranged one after another: a fixing section for fixing the profile element to a base; a support section for attachment to the façade panel; and a spacer element which, in the installed state, ensures the correct distance between the base and the rear side of the façade panel. The profile element is extendible by a supplementary element, which has functionally similar elements and is only used if required by the geometry of the façade panel. The supplementary element is usable for positive connection to the profile element of an adjacent façade panel. Such a façade system provides flexibility for a wide variety of types and dimensions of façade panels.

15 Claims, 3 Drawing Sheets

(56) References Cited

U.S. PATENT DOCUMENTS

| | | | | |
|---|---|---|---|---|
| 2003/0046891 | A1* | 3/2003 | Colada | B32B 13/12 52/541 |
| 2006/0151096 | A1* | 7/2006 | Bentmar | B32B 37/0038 156/244.11 |
| 2012/0317909 | A1* | 12/2012 | MacKenzie | E04F 13/0803 52/698 |
| 2014/0182225 | A1* | 7/2014 | Wilkie | E04F 13/0835 52/302.1 |
| 2020/0087921 | A1* | 3/2020 | Sawada | E04F 13/0803 |

FOREIGN PATENT DOCUMENTS

| | | | | |
|---|---|---|---|---|
| EP | 1277895 | | 1/2003 | |
| EP | 2508106 | B1 * | 12/2016 | A47F 5/0846 |
| EP | 3822428 | | 5/2021 | |

* cited by examiner

Fig. 3
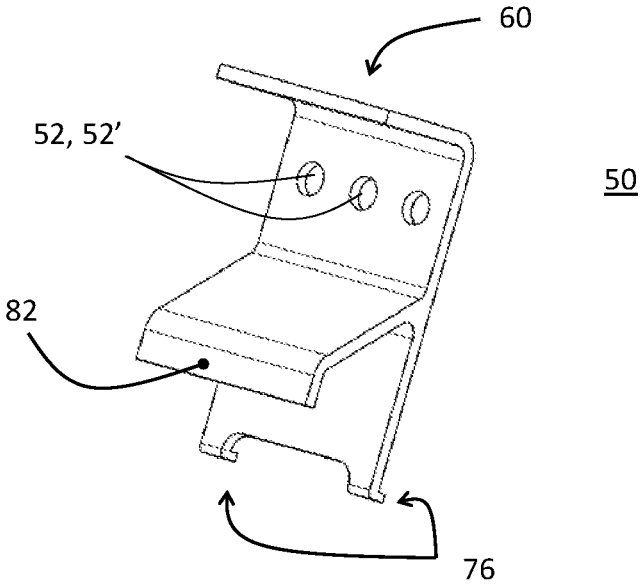
Fig. 4
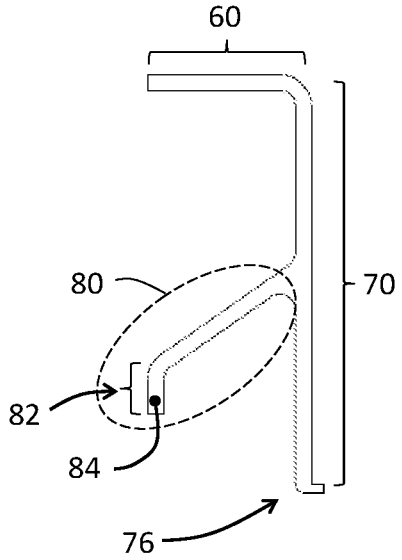
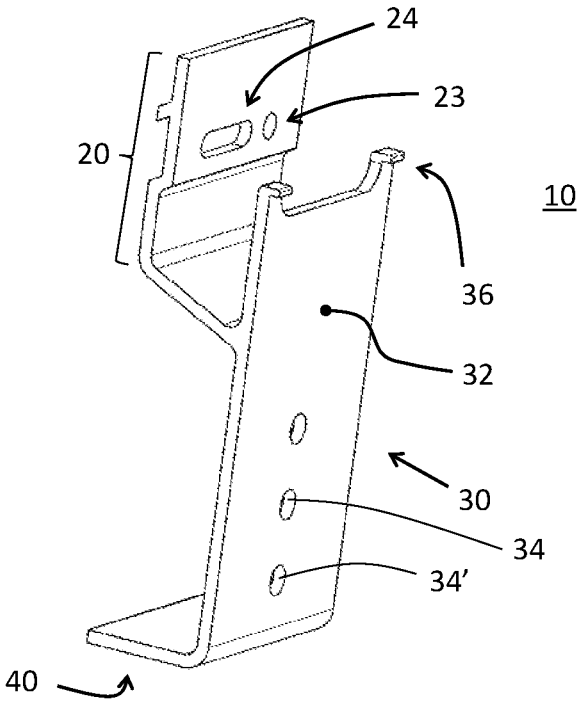
Fig. 5
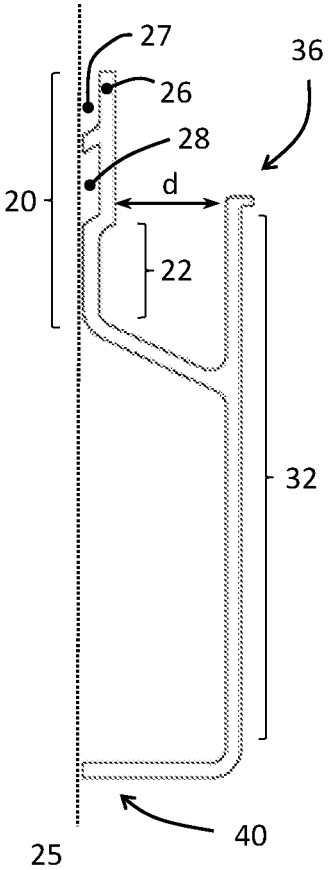
Fig. 6

FACADE FASTENING SYSTEM HAVING PROFILE ELEMENTS

INCORPORATION BY REFERENCE the following documents are incorporated herein by reference as if fully set forth: European Patent Application No. 21191138.3, filed Aug. 12, 2021.

TECHNICAL FIELD

The present invention relates to a system for fastening façades, more precisely: an invisibly fastened, curtain-type, rear-ventilated façade system having profile elements, which is simplified compared to the prior art and allows more flexible assembly. Furthermore, an assembly method is described that allows fast fastening of façade elements using such profile elements.

BACKGROUND

The term "building envelope" is used in the following to refer to all the components that close off a building from the outside. In modern residential and commercial construction, a building envelope today must fulfill a variety of functions; for example, as a barrier against weather influences, as thermal and acoustic insulation, and not least as a design element that gives a building its recognition value. In this context, a curtain façade is understood to be a building envelope that is not applied directly to a wall like a layer of plaster or a coat of paint, but is attached at a distance from it. Often, insulation layers are then applied between the load-bearing building wall and the façade elements.

PRIOR ART

A large number of façade variants are known in the prior art. In general, a curtain façade requires a substructure that defines the distance between the load-bearing building structure and the externally visible façade element. For this purpose, it is known to use horizontal and/or vertical profile rail systems, which are placed with spacer elements (beams) in front of the supporting building structure and thus form a grid. The façade elements themselves are then fastened to the profile rails (i.e. suspended, screwed on, snapped in, glued, riveted).

The weight, size and material of the façade elements have a significant influence on the type of fastening, both of the façade elements to the profile rails and of the profile rails to the load-bearing building structure. The spacer elements/beams must transfer the load through the curtain façade elements to the structurally supporting walls. In addition, wind loads, thermal influences and architectural requirements must be taken into account. This requires a not inconsiderable effort in the planning and installation of a substructure.

Large façade panels are often used for aesthetic reasons, which of course have to be adapted to windows, doors, building corners and roof edges. Especially the installation at the lower edge of windows or roof edges should be possible without any problems. It should also be possible to easily dismantle individual façade elements, either to replace them if they are damaged or to access the insulation or building structure behind them.

Such large-surface façade elements can be made of many different materials, such as metal, natural stone, plastics, etc. Often, such façade panels are to be attached "invisibly", so that the mechanical connection points to the substructure do not appear externally. Due to the thermal expansion of the façade panels, these connection points must also be created with sliding and fixed points so as not to build up unnecessary mechanical stresses between the building envelope and the substructure. Last but not least, a solution to this object must not require any compromises in terms of installation effort and safety.

The specification EP 3 536 873 A1 shows a profile element that is arranged on the rear side of a façade panel on the one hand and is attached to a building wall or a façade support on the other. It is made in one piece and has three sections; an upper mounting section in the mounted state with a step-shaped recess forming a kind of spring; a lower receiving section with a groove-like receiving space and a fastening section in between. The assembly is carried out by mounting a profile element to the rear side of a façade panel via the fastening section. The façade elements are then mounted horizontally on the building wall from bottom to top, with the downward-facing receiving section of the profile element currently being mounted being pushed onto the spring of the mounting section of the profile element already mounted.

The disadvantage of this solution is that this profile element defines a fixed horizontal grid because of the tongue and groove principle of the integral profile element. It is therefore limited—at a given nominal distance between two façade panels—to exactly one height of façade panels.

SUMMARY

The invention therefore has the object of describing a façade system that requires as few components as possible, is easy to install and adjust, and can be fastened invisibly. Furthermore, it should be more flexible to handle than the known prior art. This object is solved by a façade system with one or more of the features described herein.

In the following, "façade panel" refers to components that are to be attached to a substructure as part of a building envelope. These façade elements are usually large-surface, flat and have a square or rectangular basic shape. They can be made of metal, fiber cement, fiberglass concrete, plastics, natural stone, ceramics, or composite materials (laminated or sandwich panels made of exterior metal panels with an intermediate honeycomb core). They are used for protection, insulation, boarding, sound absorption and/or decoration of the building envelope.

Furthermore, the invention described below can also be used for intelligent façade panels. Intelligent façade panels are understood to be panels that are functionally active beyond decoration and covering. This includes, for example, solar panels, lighting or illumination elements, thermal collector or radiation elements, display elements for signaling and advertising, or sensor surfaces with a measuring function or input elements. Technically useful combinations of one or more such intelligent functions are also included.

"Holding elements" are understood to be mechanical components that can establish a load-bearing connection between a component to be held (e.g. façade element) and a receiving surface (e.g. statically load-bearing building surface). The holding elements as a whole thus form the substructure. Holding elements can be designed in such a way that they are invisible after installation of the building envelope, i.e. they are concealed by the façade for an observer after completion of the building envelope.

"Structures" mean buildings such as residential and industrial buildings, but also other structures that can or should be provided with façades or façade-like cladding. In connection with, for example, sound insulation elements or intelligent panels, structures can also mean bridges, retaining walls or similar functional buildings.

The present invention is based on a profile element, as described below, which can be used alone with sufficiently narrow façade panels. Furthermore, a combination of profile element and supplementary element is also described, which, used in pairs, is also capable of fixing higher (viewed in the assembly position) façade panels.

This profile element is designed, on the one hand, to be attached to the rear side of a façade panel and, on the other hand, to be attached to a base or support, such as a building surface or a substructure. The profile element itself is made in one piece and comprises three functional sections arranged one after the other:

- a fixing section for contact with and fixing to a base (i.e. a building surface or a load-bearing substructure);
- a support section for attachment to the rear side of a façade panel; and
- a spacer element that functionally acts only as a spacer and dissipates compressive forces that occur, ensuring the correct distance between the base and the rear side of the façade panel in the installed state.

The enumeration of the functional sections is in the order or logic "from top to bottom" when the profile element is used as intended. In this case, the fixing section would belong to the "top" section of the profile element.

The fixing section and the support section also define two parallel (in the installed state: vertical) planes. This means a first plane where the profile element meets the base ("plane of the contact surface", on the building side) and, secondly, the plane where the profile element and the façade panel meet (on the surrounding side), corresponding to the rear side of the façade panel, where the connection between the façade panel and the profile element takes place.

The design described above, in which the building-side contact surface and the plane of the support section are parallel, describes the most common application. It is clear to the person skilled in the art that the building surface (or the contact plane formed by the substructure) and the façade do not necessarily have to be parallel planes. Thus, an overlapping fastening of façade panels similar to roof shingles can be realized with a modified profile element without abandoning the inventive core.

The formulation used above "a spacer element that functionally acts only as a spacer and dissipates compressive forces that occur" means that the spacer element is neither structurally nor functionally intended or suitable for forming a connection (positive locking, frictional locking, coupling, engagement . . . ) with another similar profile element.

The fixing section has an essentially flat, level contact surface which, in the (intended) installed state, can lie flush against the said base or support (structure, substructure). This does not rule out further elements in the fixing section, nor does it rule out structuring or coating of the contact surface itself.

The support section will also have an essentially flat, level fastening surface, which in the installed state can preferably lie flush with the surface but also positively (via grooves, ridges or grooves) against the rear side of the façade panel.

Preferably, the profile element will have through-holes in the support section which are intended to receive screws, rivets or threaded bolts that ensure the connection between the profile element and the façade panel. Through-holes are to be understood in a broad sense as round holes, with—depending on the intended use—also preformed threads or slotted holes. The fastening of façade panels depends on the type of panels, their weight and other specifications, therefore equivalent technical solutions are included under the term through-holes.

One or more markings (for self-drilling screw(s)) and/or a through-hole or other receptacle may be provided on the fixing section of the profile element for a fastener to connect the profile element to the base. A marking may be a colored dot or an impression that facilitates the drilling of a self-drilling screw. A conventional through-hole (punched out, pre-drilled at the factory) can also be provided. The use of thread-forming screws and self-drilling screws is intended for use with this profile element and is also common for assembly purposes.

The fixing section of the profile element will also preferably have an edge area which tapers outwards in the shape of a tongue. Outwardly means towards its end opposite the spacer element; in the installed state this would correspond to "upwardly". This edge area is recessed from the plane of the contact surface (on the building surface or substructure, i.e. the base) and thus forms a groove or slot or pocket between itself and the base in the installed state. Depending on the design of the tongue-shaped edge section, the groove may have a substantially rectangular, wedge-shaped (funnel-shaped groove) or rounded (e.g. semicircular or quarter-round) profile when viewed in cross-section. The fixing section, in particular the edge region just described, projects beyond the edge of the façade panel in the installed state.

In functional terms, the spacer element performs only a support function between the planes of the support section and the fixing section. It can be implemented most simply as a bent flat element projecting 90° from the plane of the support section, which is supported with its open end on the plane of the building surface or the substructure (base) in the installed state. A separate fastening option (bolting) to the substructure is not provided. The dimensioning of the support section and the spacer element is such that, when the profile element is attached to the façade panel, they remain hidden behind the panel.

As already mentioned, a profile element is oriented at one edge (in the installed state: the upper, horizontal edge) and then extends at right angles to it. To facilitate alignment of the profile element on the façade panel, for example in the course of pre-assembly, stop means can be provided where the edge of a façade element is to come to rest on the support section. For this purpose, stop edges, stop lugs or claws can be provided on the profile element in the support section, which positively grip around the edge of the façade panel.

The profile element described so far is—used on its own—intended for façade panels that—when mounted vertically—are not too high. Depending on the weight of the façade panel, one type of profile element can be used for different heights and different materials—within the limits set by statics and building regulations. However, if the façade panels become larger or more extensive, in particular "higher", then a profile element attached to the upper edge will no longer be sufficient. Obviously, it would be possible to extend the load-bearing section or fixing section to accommodate a larger façade element. However, this is not desirable because it unnecessarily increases the material consumption of the profile element and thus costs and weight. It has therefore proved advantageous to complete the profile element with a supplementary element for the described field of application.

This results in a two-part profile element combination made of a profile element as described above and a supplementary element. The supplementary element itself is again designed in one piece and comprises three functional sections arranged one after the other. These are functionally comparable with the profile element and are also described here in the logic "from top to bottom, if properly installed":

- A spacer that functionally acts only as a spacer and only dissipates compressive forces that occur, ensuring the correct distance between the base and the rear side of the façade panel when installed;
- A support area that can be connected to the rear side of a façade panel; and
- A connecting section which has a pin or lug at one end and a contact surface to the base, wherein the pin—in the installed state—permits positive engagement in a groove such as is or can be formed by the fixing section of an (adjacent) profile element with the base (in the correctly installed state).

From this description or interpretation, it is clear that a supplementary element will initially be attached to the lower edge of a façade element, it is functionally upside down, so to speak, compared to the profile element. The spacer (as an analogue to the spacer element of the profile element) is at the top in the installed state. The connecting section with its pin faces downwards and can engage in the groove of a profile element; in the assembly logic, this would be the profile element of a façade panel already arranged below. Since, as mentioned above, the fixing section of this correctly installed profile element, in particular the edge area, projects beyond the edge of the façade panel (upwards), inserting the pin of the supplementary element into the groove of the adjacent profile element arranged in the fall line is simple. In addition, this ensures a defined distance between the supplementary element and the profile element, which makes it easier for the fitter to produce a clean façade appearance.

Analogous to the profile element, the supplementary element can have stop means for the façade panel, also to facilitate alignment of the profile element on the façade panel in the course of pre-assembly. For this purpose, stop edges, stop lugs or claws can be implemented on the supplementary element in the support area, which positively grip around the edge of the façade panel.

The profile element combination of profile element and supplementary element described so far can preferably be extruded from aluminum and then cut to suitable length. Fixing holes, through-holes, embossing, markings, coatings such as paint applications or corrosion protection can be applied in further processing steps, e.g. by punching, pressing, drilling, forming, milling, stamping, imprinting, lasering, spraying, immersion baths etc. Alternatively, the profile element and supplementary element can be formed and/or assembled from bent sheet metal parts (by stamping, welding) or manufactured as plastic injection molding elements.

The width (again, considered in the installed state) of a profile element, as well as its length and material thickness, will be selected or designed automatically by a person skilled in the art so that the static requirements can be met. These are in turn determined by the weight of the façade panel and the expected environmental influences such as wind pressure and wind suction.

For the purposes of the present invention, a façade system for mounting façade panels on a substrate such as a building surface or a substructure is a combination of façade panels and profile elements or profile element combinations as described above. The connection between façade panel and profile element or façade panel and supplementary element can be made in a known manner by means of screws, rivets, threaded bolts or by adhesives. Depending on the façade panel, the connection between the panel and profile/supplementary element may be sufficient via one connection point or via a plurality of them.

A special feature of the façade system presented here is the possibility of selecting particularly narrow horizontal gaps between two adjacent façade panels. This is desirable for both aesthetic and functional reasons (weather protection). In the prior art, the limit for the gap width is usually reached where a fastener such as a screw must be reached through the gap by a suitable tool. Loosening an existing façade, e.g. for repairs, then becomes a problem.

Furthermore, the head diameter of a fastener is usually generously dimensioned because this widening forms an abutment surface and thus plays a decisive role in the strength of the fastening point. However, if the diameter of the head of the fastener is too large, it will not be able to pass through the (narrower) gap between the façade panels when the fastening point is to be re-established after replacing a panel in the façade.

Therefore, in the façade system presented here, the vertically measured distances between the horizontal edges of two adjacent façade panels can be selected in such a way that the gap formed is sufficient for the insertion and actuation of a fastening or release tool for a fastener that forms a fastening point between the profile element and the base in the area of the fixing section. In other words, the head size of the fastener is not important, but the tool dimensions are. If an existing, mounted façade panel is to be loosened, another condition must be met: The tool must be able to release the fastener at its effective length from the fastening point. For this purpose, the length of the fastener must be chosen shorter than the clear width d between the mutually facing and opposing surface sections of the fixing section and the support section. The length of the fastener is essentially determined by the loads to be transferred from the profile element to the substructure/support and the thickness of the material in which the fastener engages (support of the substructure). The sizes must be taken into account when dimensioning the fastener and coordinated with the above-mentioned clear width. This results in a coordinated system whose parameters can be determined according to the above considerations.

The façade system described above opens up, above all, as mentioned, new perspectives for the maintainability of façade systems. Thus, it can show its advantages where a decorative element, a cover panel, a solar panel, a light or lighting element, a thermal collector or radiating element, a soundproofing element, a display element, a sensor surface, or a technically useful combination of one or more such elements, are used as a façade panel.

A method for installing a façade system as described above proceeds as follows, by way of example:

A profile element and a supplementary element are attached to the façade panel at designated locations. Location and number are determined by regulations and static calculations. Then the façade panel is aligned to a support such as a load-bearing substructure of a building or a building envelope. For the first element, alignment is achieved using spirit level and plumb/markings on the building or technical/electronic aids. Subsequently, the fixing can be carried out e.g. by screwing the profile element in the area of the contact surface of the fixing section. The installation plan will determine whether a fixed point or a sliding point is to be set. A further façade panel thus prepared can be installed very simply by lifting the next façade panel over the panel already set, in such a way that the supplementary elements of the new panel are aligned with the profile elements of the existing panel and rest on the substructure/base. Then the façade panel can be moved downwards until the pin in the connecting section slides into the groove of the profile element underneath, thus ensuring the correct slot spacing. Then, in turn, on the upper edge of the newly set panel, the fixing points on the fixing sections can be realized.

If no profile element combination is used, but only one profile element without supplementary element due to the dimensions of the façade panel, the possibility of adjusting the horizontal gaps via pin and groove is eliminated. In this case, the façade elements can be aligned, for example, with the help of temporary spacer blocks inserted in the slot.

BRIEF DESCRIPTION OF THE DRAWINGS

FIGS. 3 and 4 show a supplementary element 50 in perspective view and in cross-section.

FIGS. 5 and 6 show a variant of a profile element 10 in perspective view and in cross-section.

DETAILED DESCRIPTION

Figure 1:
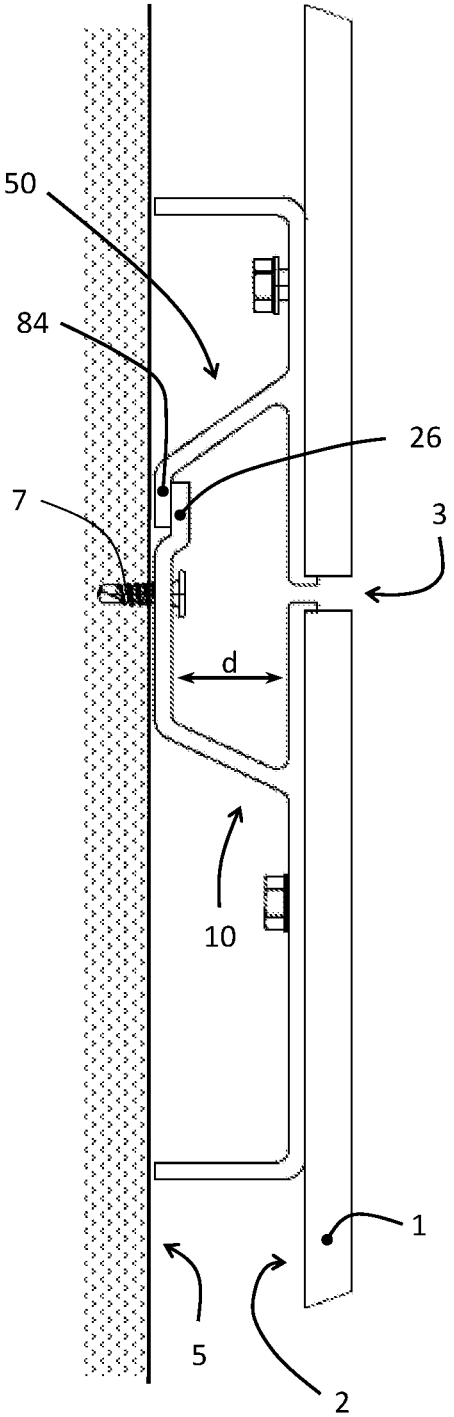
FIG. 1 shows a vertical cross-section through an assembled connection of profile element 10, supplementary element 50 and two façade panels 1 on a base 5.

FIG. 1 shows a basic configuration of a profile element 10 and a supplementary element 50. Two façade panels 1 (cut away) are spaced apart by a narrow gap 3, the width of which is determined by the engagement of the pin 84 (supplementary element 50) in the groove formed between the edge region 26 of the profile element 10 and the base 5. Profile element 10 and supplementary element 50 are connected to the rear side 2 of the façade panels 1 on the one hand and rest against the base 5 on the other. Base 5 is shown schematically and can represent a building surface or a substructure. The profile element 10 is fixed to the base 5 by means of a fastener 7. Also marked in FIG. 1 is the clear distance d between the facing and opposite surface sections of the fixing section and the support section.

Figure 2:
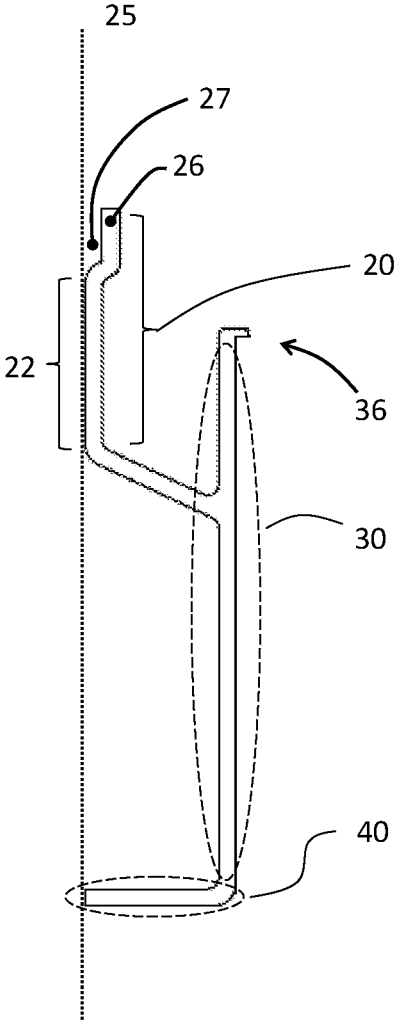
FIG. 2 shows, from the same perspective, only the profile element 10.

FIG. 2 shows some of the components of the profile element 10. These are, in the drawing from top to bottom, the fixing section 20, the support section 30 and the spacer element 40. The fixing section 20 extends, in the drawing upwards, into the edge area 26, which no longer lies flat on the base 5 like the contact surface 22. The marking 25 marks the plane of the contact surface 22 or of the base 5 in FIG. 2. The groove, slot or pocket 27 is thus formed between the edge area 26 and plane 25.

In the support section 30, the support surface for a façade panel 1 (omitted) can be seen; in the drawing, it terminates at the top with stop means (edge, lug, claw) 36. This function is easily seen in the cross comparison of FIG. 1 with FIG. 2. At the lower end, the support section 30 merges into the spacer element 40, which is simply realized here as a beveled element that helps ensure the distance between the support section 30 and the plane 25.

FIGS. 3 and 4 show a supplementary element 50 that can be used together with a profile element 10. It is of simpler construction than a profile element 10, but has functionally similar sections. In the drawing above, arranged similarly to the intended use, is spacer 60, which has the same functions and limitations as spacer element 40 of a profile element 10. It transitions into a support area 70, which is intended to rest against the lower edge of a façade panel. Similar to the stop means 36, the support area 70 also has a stop edge, stop lug(s) or claw(s) 76 that can determine the relative position of the supplementary element 50 on the lower edge of a façade panel. Further arranged in the support area 70 is the connecting section 80, which opens into a support part 82, which in turn merges into the pin 84. In FIG. 3, various pilot holes/through-holes 52, 52' can also be seen, which can be used for the connection to a façade panel FIGS. 5 and 6 show a variant of a profile element 10 similar to FIG. 2. The differences relate to the fixing section 20, more precisely the edge area 26, which still forms a pocket or groove 27 with a base 5 or the associated plane 25. However, compared to FIG. 1, the contact surface 22 is reduced in size because part of this surface recedes from the plane 25 earlier than necessary for the groove 27. This forms an additional recess 28, the function of which becomes clear when viewed together with FIG. 5. In the area of the recess 28, a through-hole 24 (oblong hole) and a marking are provided. The recess allows drill chips to be accommodated when setting a fastener and prevents the profile element from being pressed out of the nominal position on the base 5/plane 25 by this drill material. In FIG. 5, predrilled holes 34, 34' can also be seen, which are used for fastening the façade panel/support section 30 via fastening surface 32.

Figure 7:
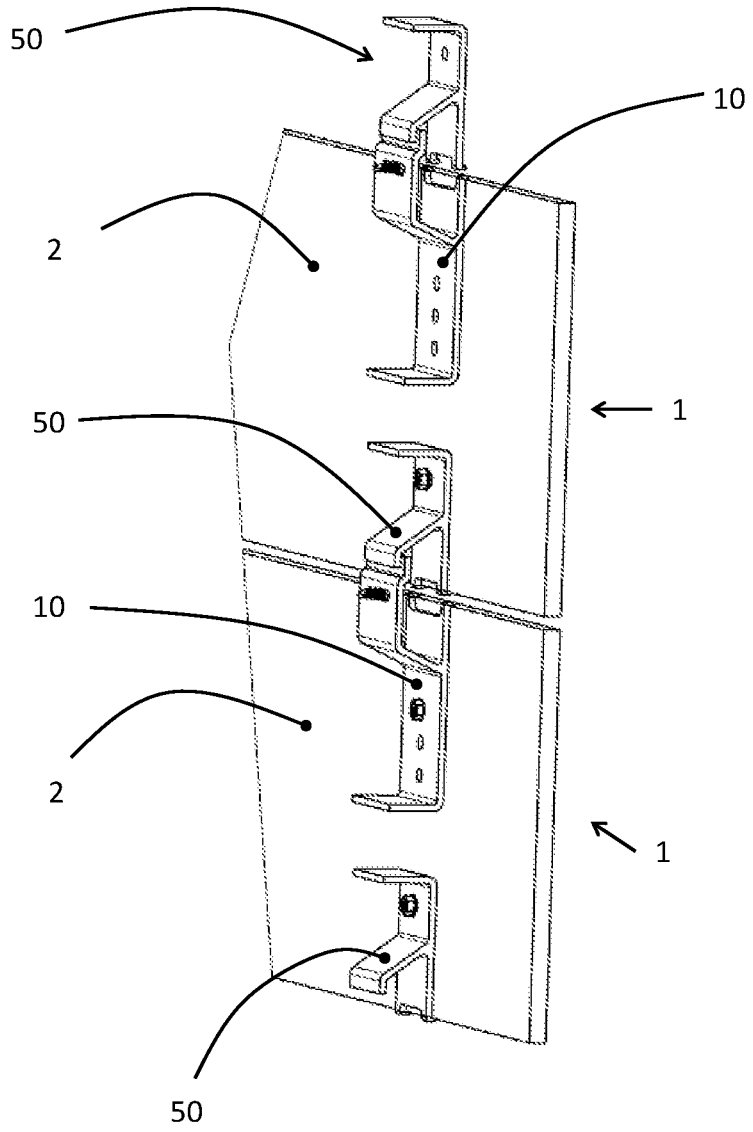
FIG. 7 shows a rear view of two façade panels with interlocking profile element and supplementary element.

FIG. 7 in turn shows a perspective view of two façade panels 1 from the rear side 2, with a profile element 10 and a supplementary element 50 being in positive engagement with each other.

The invention claimed is:

1. A profile element (10) for attachment to a rear side (2) of a façade panel (1) and fastening to a base (5), the profile element (10) comprising:

an integrally formed single piece comprising a fixing section, a support section, and a spacer element (20, 30, 40) arranged one after another, the fixing section (20) being configured for contact with and fixing to the base (5), the support section (30) being configured for attachment to the rear side (2) of the façade panel (1), and the spacer element (40) forming a spacer that is configured to only dissipate compressive forces that occur to ensure a correct distance between the base and the rear side of the façade panel in an installed state, wherein the support section (30) has a substantially flat, planar fastening surface (32) which, in the installed state, lies at least one of flush or positively against the rear side (2) of the façade panel (1).

2. The profile element (10) according to claim 1, wherein the support section (30) has through-holes (34, 34') configured for receiving at least one of screws, rivets, or threaded bolts, which are provided for connecting the profile element (10) and the façade panel (1).

3. The profile element (10) according to claim 1, wherein the fixing section (20) has at least one of a marking (23) for self-drilling screws or a through-hole or receptacle (24) for a fastener for connecting the profile element (10) to the base (5).

4. The profile element (10) according to claim 1, wherein the fixing section (20) has a substantially flat, planar contact surface (22) which, in the installed state, lies flush with the surface of the base (5).

5. The profile element (10) according to claim 4, wherein the fixing section (20) further comprises an edge region (26) which tapers outwards in a tongue shape and recedes from a plane (25) of the contact surface (22), thus forming a groove (27) between the fixing section and the base in the installed state.

6. The profile element (10) according to claim 5, wherein the groove (27) has a substantially rectangular, wedge-shaped or rounded profile in cross-section.

7. A two-part profile element combination, comprising:

the profile element (10) according to claim 1;

a supplementary element (50) formed in one piece and comprising a spacer (60), a support area (70) and a connecting section (80) arranged one after another, the spacer (60) acts only as a spacer member and dissipates compressive forces that occur, which in the installed state ensures the correct distance between the base and the rear side of the façade panel, the support area (70) is configured for attachment to the rear side of the façade panel; and the connecting section (80) comprises a pin (84) at one end and a contact surface (82) to the base (5), and the pin (84), in the installed state, permits positive engagement in a groove (27) formed by the fixing section of the profile element (10) with the base (5).

8. The profile element combination according to claim 7, wherein at least one of the profile element (10) or supplementary element (50) is extruded from aluminum, are formed or assembled from bent sheet metal parts or are produced as plastic injection molding elements.

9. A façade system for mounting façade panels on a base (5), the system comprising façade panels as well as the profile element according to claim 1.

10. The façade system according to claim 9, wherein, in the installed state, vertically measured distances of horizontal edges of two adjacent façade panels from one another are selected such that a gap formed is configured for insertion and actuation of a fastening or loosening tool for a fastener (7) which forms a fastening point between the profile element (10) and the base (5) in a region of the fixing section.

11. The façade system according to claim 9, wherein a length of a fastener (7) is selected shorter than a clear width (d) between mutually facing and opposing surface sections of the fixing section (20) and the support section (30).

12. The façade system according to claim 9, wherein the façade panel (1) is at least one of a decorative element, a cover panel, a solar panel, a light or lighting element, a thermal collector or radiation element, a sound insulation element, a display element, or a sensor surface.

13. The façade system according to claim 9, wherein the base is a building surface or a substructure.

14. A façade system for mounting façade panels on a base (5), the system comprising façade panels as well as the profile element combination according to claim 7.

15. The façade system according to claim 14, wherein connection between the façade panel (1) and at least one of the profile element (10) or the supplementary element (50) is made by at least one of screws, rivets, threaded bolts, or glue.

* * * * *